US006189814B1

(12) United States Patent
Richards

(10) Patent No.: US 6,189,814 B1
(45) Date of Patent: Feb. 20, 2001

(54) GAS TURBINE ENGINE COMBUSTION CHAMBER

(75) Inventor: Brian Richards, Leicestershire (GB)

(73) Assignee: Rolls-Royce plc, London (GB)

( * ) Notice: Under 35 U.S.C. 154(b), the term of this patent shall be extended for 0 days.

(21) Appl. No.: 09/206,964

(22) Filed: Dec. 8, 1998

Related U.S. Application Data

(62) Division of application No. 09/064,616, filed on Apr. 23, 1998, now abandoned, which is a continuation of application No. 08/446,576, filed on May 19, 1995, now Pat. No. 5,797,267.

(30) Foreign Application Priority Data

May 21, 1994 (GB) ..... 9410233

(51) Int. Cl.[7] ..... B05B 7/04; F23R 3/34
(52) U.S. Cl. ..... 239/434; 60/737
(58) Field of Search ..... 60/737, 746, 747; 239/434

(56) References Cited

U.S. PATENT DOCUMENTS

| | | | |
|---|---|---|---|
| 4,058,977 | 11/1977 | Markowski . | |
| 4,850,194 | 7/1989 | Fuglistaller . | |
| 5,101,633 | 4/1992 | Keller et al. | 60/737 |
| 5,319,935 | 6/1994 | Toon et al. | 60/737 |
| 5,359,847 | 11/1994 | Pillsbury . | |

FOREIGN PATENT DOCUMENTS

| | | |
|---|---|---|
| 2937631 | 4/1981 | (DE) . |
| 0169431 | 1/1986 | (EP) . |
| 274630 | 11/1987 | (EP) . |
| 0281961 | 9/1988 | (EP) . |
| 2206442 | 6/1974 | (FR) . |
| 723010 | 2/1955 | (GB) . |
| 2010408 | 6/1969 | (GB) . |
| 1489339 | 10/1977 | (GB) . |
| 92 07221 | 4/1992 | (WO) . |
| 94 28357 | 12/1994 | (WO) . |

*Primary Examiner*—Michael Koczo
(74) *Attorney, Agent, or Firm*—W. Warren Taltavull; Farkas & Manelli PLLC

(57) ABSTRACT

A gas turbine combustion chamber which has primary, secondary and tertiary combustion zones in flow series has a secondary mixing duct and a tertiary mixing duct. The secondary and tertiary mixing ducts reduce in cross-sectional area from their intakes to their outlet apertures to provide an accelerating flow through the mixing ducts to prevent the formation of recirculating zones, Fuel injectors have fuel discharge apertures downstream of any recirculating zones formed at the intakes The fuel injectors extend across a major portion of the width of the ducts to effectively subdivide the ducts over tat least part of the streamwise length of the ducts. The portions of the fuel injectors within the ducts are oval shaped in cross-section and the portions outside the ducts are aerofoil shaped in crosssection. The fuel injectors reduce in dimension perpendicular to the widthwise direction of the duct.

6 Claims, 4 Drawing Sheets

GAS TURBINE ENGINE COMBUSTION CHAMBER

This is a Divisional of: National Application Ser. No. 09/064,616 filed Apr. 23, 1998, abandoned, which is a continuation of Ser. No. 08/446,576 filed May 19, 1995 now U.S. Pat. No. 5,797,267.

The present invention relates to a gas turbine engine combustion chamber.

BACKGROUND OF THE INVENTION

In order to meet the emission level requirements, for industrial low emission gas turbine engines, staged combustion is required in order to minimise the quantity of the oxides of nitrogen (NOx) produced. Currently the emission level requirement is for less than 25 volumetric parts per million of NOx for an industrial gas turbine exhaust. The fundamental way to reduce emissions of nitrogen oxides is to reduce the combustion reaction temperature and this requires premixing of the fuel and all the combustion air before combustion takes place. The oxides of nitrogen (NOx) are commonly reduced by a method which uses two stages of fuel injection. Our UK patent no 1489339 discloses two stages of fuel injection to reduce NOx. Our International patent application no WO92/07221 discloses two and three stages of fuel injection. In staged combustion, all the stages of combustion seek to provide lean combustion and hence the low combustion temperatures required to minimise NOx. The term lean combustion means combustion of fuel in air where the fuel to air ratio is low, ie less than the stoichiometric ratio.

The present invention is particularly concerned with gas turbine engines which have staged combustion, and more particularly concerned with the secondary fuel and air mixing duct and secondary fuel injection or tertiary fuel and air mixing duct and tertiary fuel injection.

In order to inject fuel into the secondary, or tertiary fuel and air mixing ducts, it is known to use cylindrical fuel injectors which extend across the inlet to the mixing duct as described in our copending UK patent application 9310690.4 filed May 24, 1993. This arrangement has suffered from preburning of fuel in the air in the mixing duct whereas the fuel should not burn until it is in the appropriate combustion zone. The fuel burns in the air in the mixing duct because of recirculation of the fuel and air in regions immediately downstream of the fuel injectors and due to hot gases in the combustion zone flowing upstream into the mixing duct.

SUMMARY OF THE INVENTION

The present invention seeks to provide a combustion chamber which reduces or overcomes these problems.

Accordingly the present invention provides a gas turbine combustion chamber comprising at least one combustion zone defined by at least one peripheral wall, means to define at least one fuel and air mixing duct for conducting a mixture of fuel and air to the at least one combustion zone, each mixing duct having an upstream end for receiving air, an intermediate region for receiving fuel and a downstream end for delivering a fuel and air mixture into the at least one combustion zone, each mixing duct reducing in cross-sectional area from its upstream end to its downstream end to produce an accelerating flow therethrough, at least one fuel injector for injecting fuel into the intermediate region of the at least one mixing duct, each fuel injector extending in a downstream direction along the at least one mixing duct to the intermediate region, each fuel injector being effective to subdivide the at least one mixing duct into a plurality of ducts over at least a part of the streamwise length of the at least one mixing duct, each fuel injector having a plurality of discharge apertures positioned to inject fuel into the intermediate region of the at least one mixing duct, said discharge apertures injecting fuel transversely of the streamwise direction.

The fuel injector may extend the full length of the at least one mixing duct, to subdivide the at least one mixing duct into a plurality of ducts over the full streamwise length of the at least one mixing duct.

At least one wall may extend in a downstream direction along the at least one mixing duct, each wall being effective to subdivide the at least one mixing duct into a plurality of ducts over at least a part of the streamwise length of the at least one mixing duct.

The at least one fuel injector may extend over an upstream portion of the mixing duct, the wall extends over a downstream portion of the mixing duct, the downstream end of the fuel injector being positioned substantially immediately upstream of the upstream end of the wall such that the fuel injector and the wall cooperate to subdivide the at least one mixing duct into a plurality of ducts over the full streamwise length of the at least one mixing duct.

The at least one fuel injector may extend over an upstream portion of the mixing duct, the fuel injector reducing in cross-sectional area from its upstream end to its downstream end.

The downstream end of the fuel injector preferably has a relatively sharp edge.

Preferably the portion of the fuel injector positioned within the mixing duct has a race track cross-section.

Preferably the fuel injector extends through the upstream end of the mixing duct, a portion of the fuel injector is positioned outside the mixing duct.

Preferably the portion of the fuel injector outside the mixing duct has an aerofoil cross-section.

Preferably the fuel injector extends in a first direction transversely relative to the streamwise direction across a major portion of the at least one mixing duct.

Preferably the fuel injector has at least a portion of substantially constant dimension in the first direction, the portion is arranged between the upstream end and the intermediate region of the mixing duct.

Preferably the portion of the fuel injector positioned outside the mixing duct reduces in cross-sectional area towards the portion of the fuel injector positioned within the mixing duct.

Preferably the fuel injector reduces in dimension in a second direction transversely relative to the streamwise direction, between the upstream end and the intermediate region of the mixing duct, the second direction is perpendicular to the first direction.

Preferably there is a uniform reduction in dimension in the second direction.

Preferably a plurality of fuel injectors are provided.

The combustion chamber may have a primary combustion zone and a secondary combustion zone downstream of the primary combustion zone, the at least one fuel and air mixing duct delivers the fuel and air mixture into the secondary combustion zone.

The peripheral wall may be annular, the at least one fuel and air mixing duct is arranged around the primary combustion zone.

The combustion chamber may have a primary combustion zone, a secondary combustion zone downstream of the primary combustion zone and a tertiary combustion zone downstream of the secondary combustion zone, the at least one fuel and air mixing duct delivers the fuel and air mixture into the tertiary combustion zone.

The peripheral wall may be annular, the at least one fuel and air mixing duct is arranged around the secondary combustion zone.

The at least one fuel and air mixing duct may be defined at its radially inner extremity and radially outer extremity by a pair of annular walls.

Preferably a plurality of equi-circumferentially spaced fuel injectors are provided.

Preferably the combustion chamber is surrounded by a combustion chamber casing, a fuel manifold to supply fuel to the at least one fuel injector.

The present invention also provides a gas turbine combustion chamber comprising at least one combustion zone defined by at least one peripheral wall, mixing duct means for conducting a mixture of fuel and air to the at least one combustion zone, the mixing duct means having an upstream end for receiving air, an intermediate region for receiving fuel and a downstream end for delivering a fuel and air mixture into the at least one combustion zone, the mixing duct means reducing in cross-sectional area from its upstream end to its downstream end to produce an accelerating flow therethrough, a plurality of fuel injectors for injecting fuel into the intermediate region of the mixing duct means, the fuel injectors extending in a downstream direction along the mixing duct means to the intermediate region, the fuel injectors being effective to subdivide the mixing duct means into a plurality of ducts over at least a part of the streamwise length of the mixing duct means, the fuel injectors having discharge apertures positioned to inject fuel into the intermediate region of the mixing duct means, said injection occurring transversely of the streamwise direction and being directed towards adjacent fuel injectors.

The present invention also provides a gas turbine engine fuel injector comprising a member reducing in cross-sectional area in the longitudinal direction from a first end to a second end, the member reducing in dimension in a first direction perpendicular to the longitudinal direction from the first end to the second end, the member having a passage extending longitudinally therethrough for the supply of fuel from the first end towards the second end, the member having a plurality of discharge apertures at a predetermined distance from the second end, the discharge apertures being spaced apart in a second direction which is substantially perpendicular to both the first direction and the longitudinal direction, the apertures being arranged to direct fuel substantially perpendicularly to the second direction.

There may be a uniform reduction in dimension in the first direction.

Preferably at least a portion of the member has a substantially constant dimension in the second direction.

Preferably the at least a portion of the member is adjacent the second end of the member.

Preferably a portion of the fuel injector reduces in dimension in the second direction between the first end of the member and the portion of the member having a constant dimension in the second direction.

Preferably the portion of the member which has a substantially constant dimension in the first direction has a race track cross-section.

Preferably the portion of the member which reduces in dimension in the second direction has an aerofoil cross-section.

Preferably the second end of the member has a sharp edge.

BRIEF DESCRIPTION OF THE DRAWINGS

The present invention will be more fully described by way of example with reference to the accompanying drawings, in which.

Figure 1:
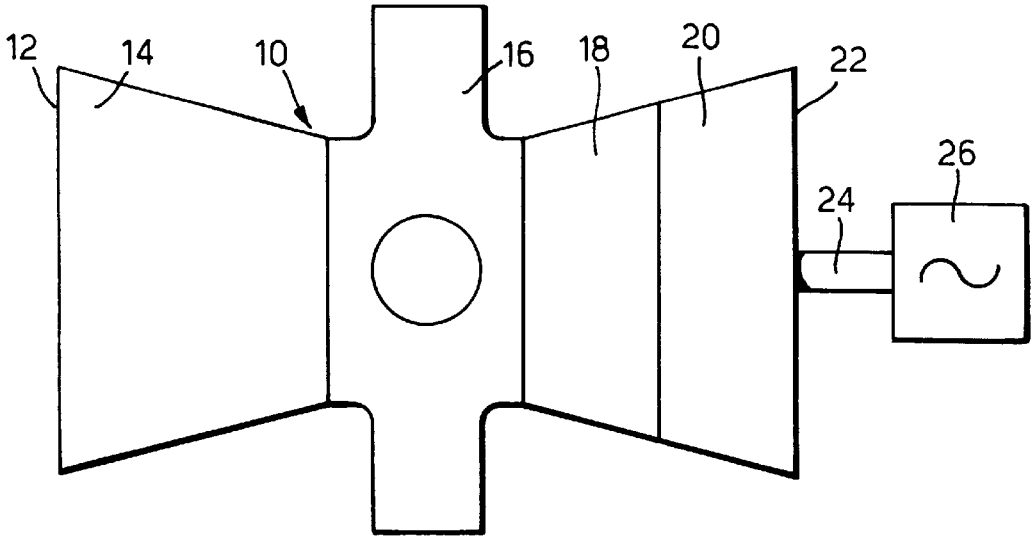
FIG. 1 is a view of a gas turbine engine having a combustion chamber assembly according to the present invention.
Figure 3:
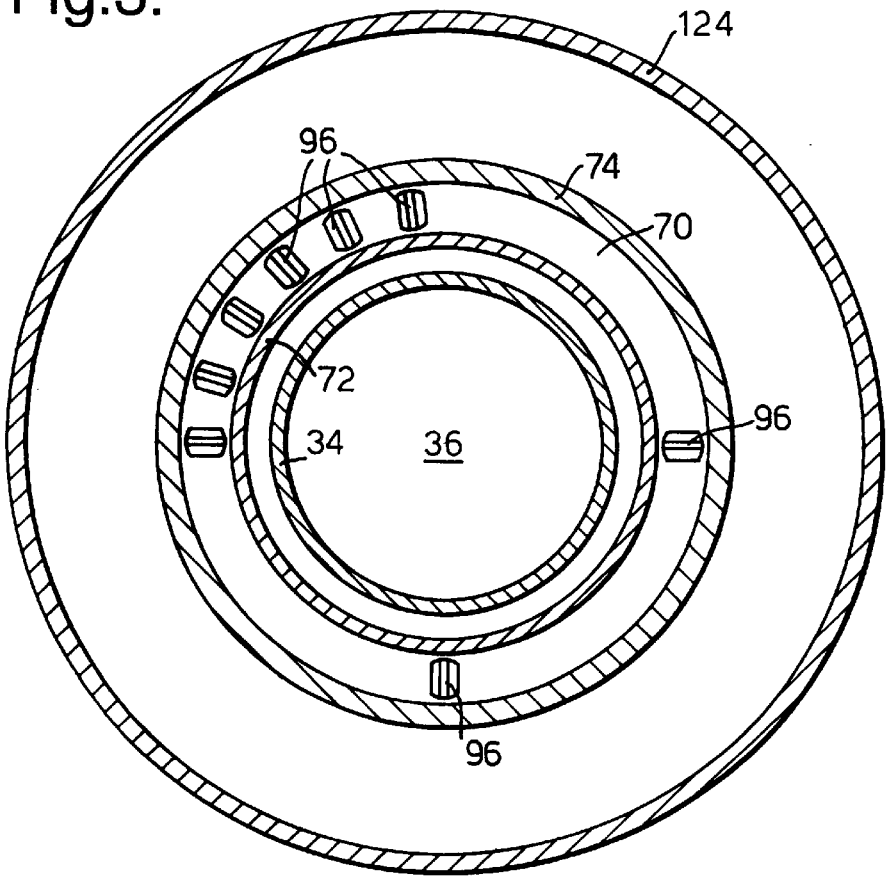
FIG. 3 is a cross-sectional view in the direction of arrows 3—3 in FIG. 2.

An industrial gas turbine engine 10, shown in FIG. 1, comprises in axial flow series an inlet 12, a compressor section 14, a combustion chamber assembly 16, a turbine section 18, a power turbine section 20 and an exhaust 22. The turbine section 18 is arranged to drive the compressor section 14 via one or more shafts (not shown). The power turbine section 20 is arranged to drive an electrical generator 26 via a shaft 24. However, the power turbine section 20 may be arranged to provide drive for other purposes. The operation of the gas turbine engine 10 is quite conventional, and will not be discussed further.

The combustion chamber assembly 16 is shown more clearly in FIGS. 2 to 5. The combustion chamber assembly 16 comprises a plurality of, for example nine, equally circumferentially spaced tubular combustion chambers 28. The axes of the tubular combustion chamber 28 are arranged to extend in generally radial directions. The inlets of the tubular combustion chambers 28 are at their radially outermost ends and their outlets are at their radially innermost ends.

Each of the tubular combustion chambers 28 comprises an upstream wall 30 secured to the upstream end of an annular wall 32. A first, upstream, portion 34 of the annular wall 32 defines a primary combustion zone 36, a second, intermediate portion 38 of the annular wall 32 defines a secondary combustion zone 40 and a third downstream portion 42 of the annular wall 32 defines a tertiary combustion zone 44. The downstream end of the first portion 34 has a frustoconical portion 46 which reduces in diameter to a throat 48. The second portion 38 of the annular wall 32 has a greater diameter than the first portion 34. A frustoconical portion 50 interconnects the throat 48 and the upstream end of the second portion 38. The downstream end of the second portion 38 has a frustoconical portion which reduces in diameter to a throat 54. The third portion 42 of the annular wall 32 has a greater diameter than the second portion 38. A frustoconical portion 56 interconnects the throat 54 and the upstream end of the third portion 42.

The upstream wall 30 of each of the tubular combustion chambers 28 has an aperture 58 to allow the supply of air and fuel into the primary combustion zone 36. A first radial flow swirler 60 is arranged coaxially with the aperture 58 in the upstream wall 30 and a second radial flow swirler 62 is arranged coaxially with the aperture 58 in the upstream wall 30. The first radial flow swirler 60 is positioned axially downstream, with respect to the axis of the tubular combustion chamber, of the second radial flow swirler 62. The first radial flow swirler 60 has a plurality of fuel injectors 64, each of which is positioned in a passage formed between two vanes of the swirler. The fuel injectors 64 are supplied fuel from a manifold 68. The second radial flow swirler 62 has a plurality of fuel injectors 72, each of which is positioned in a passage formed between two vanes of the swirler. The first and second radial flow swirlers 60 and 62 are arranged such that they swirl the air in opposite directions. For a more detailed description of the use of the two radial flow swirlers and the fuel injectors positioned in the passages formed between the vanes see our international patent application no WO92/07221. The primary fuel and air is mixed together in the passages between the vanes of the first and second radial flow swirlers 60 and 62.

An annular secondary fuel and air mixing duct 70 is provided for each of the tubular combustion chambers 28. Each secondary fuel and air mixing duct 70 is arranged coaxially around the primary combustion zone 36. Each of the secondary fuel and air mixing ducts 70 is defined between a second annular wall 72 and a third annular wall 74. The second annular wall 72 defines the radially inner extremity of the secondary fuel and air mixing duct 70 and third annular wall 74 defines the radially outer extremity of the secondary fuel and air mixing duct 70. The axially upstream end 76 of the second annular wall 72 is secured to a side plate of the first radial flow swirler 60. The axially upstream ends of the second and third annular walls 72 and 74 are substantially in the same plane perpendicular to the axis of the tubular combustion chamber 28. The secondary fuel and air mixing duct 70 has a secondary air intake 78 defined radially between the upstream end of the second annular wall 72 and the upstream end of the third annular wall 74.

At the downstream end of the secondary fuel and air mixing duct 70, the second and third annular walls 72 and 74 respectively are secured to the frustoconical portion 50 and the frustoconical portion 50 is provided with a plurality of equi-circumferentially spaced apertures 80. The apertures 80 are arranged to direct the fuel and air mixture into the secondary combustion zone 40 in the tubular combustion chamber 28, in a downstream direction towards the axis of the tubular combustion chamber 28. The apertures 80 may be circular or slots and are of equal flow area.

The secondary fuel and air mixing duct 70 reduces gradually in cross-sectional area from the intake 78 at its upstream end to the apertures 80 at its downstream end. The second and third annular walls 72 and 74 of the secondary fuel and air mixing duct 70 are shaped to produce an aerodynamically smooth duct 70. The shape of the secondary fuel and air mixing duct 70 therefore produces an accelerating flow through the duct 70 without any regions where recirculating flows may occur.

An annular tertiary fuel and air mixing duct 82 is provided for each of the tubular combustion chambers 28. Each tertiary fuel and air mixing duct 82 is arranged coaxially around the secondary combustion zone 40. Each of the tertiary fuel and air mixing ducts 82 is defined between a fourth annular wall 84 and a fifth annular wall 86. The fourth annular wall 84 defines the radially inner extremity of the tertiary fuel and air mixing duct 82 and the fifth annular wall 86 defines the radially outer extremity of the tertiary fuel and air mixing duct 82. The axially upstream ends of the fourth and fifth annular walls 84 and 86 are substantially in the same plane perpendicular to the axis of the tubular combustion chamber 28. The tertiary fuel and air mixing duct 82 has a tertiary air intake 88 defined radially between the upstream end of the fourth annular wall 84 and the upstream end of the fifth annular wall 86.

At the downstream end of the tertiary fuel and air mixing duct 82, the fourth and fifth annular walls 84 and 86 respectively are secured to the frustoconical portion 56, and the frustoconical portion 56 is provided with a plurality of equi-circumferentially spaced apertures 90. The apertures 90 are arranged to direct the fuel and air mixture into the tertiary combustion zone 44 in the tubular combustion chamber 28, in a downstream direction towards the axis of the tubular combustion chamber 28. The apertures 90 may be circular or slots and are of equal flow area.

The tertiary fuel and air mixing duct 82 reduces gradually in cross-sectional area from the intake 88 at its upstream end to the apertures 90 at its downstream end. The fourth and fifth annular walls 84 and 86 of the tertiary fuel and air mixing duct 82 are shaped to produce an aerodynamically smooth duct 82. The shape of the tertiary fuel and air mixing duct 82 therefore produces an accelerating flow through the duct 82 without any regions where recirculating flows may occur.

A plurality of secondary fuel systems 92 are provided, to supply fuel to the secondary fuel and air mixing ducts 70 of each of the tubular combustion chambers 28. The secondary fuel system 92 for each tubular combustion chamber 28 comprises an annular secondary fuel manifold 94 arranged coaxially with the tubular combustion chamber 28 at the upstream end of the tubular combustion chamber 28. The secondary fuel manifold is defined by the casing 124, but it may be positioned outside or inside the casing 124. Each secondary fuel manifold 94 has a plurality, for example thirty two, of equi-circumferentially spaced secondary fuel injectors 96. Each of the secondary fuel injectors 90 comprises a hollow member 98 which extends axially with respect to the tubular combustion chamber 28, from the secondary fuel manifold 94 in a downstream direction through the intake 78 of the secondary fuel and air mixing duct 70 and into the secondary fuel and air mixing duct 70. Each hollow member 98 extends in a downstream direction along the secondary fuel and air mixing duct 70 to a position, sufficiently far from the intake 78, where there are no recirculating flows in the secondary fuel and air mixing duct 70 due to the flow of air into the duct 70.

Each hollow member 98 extends in a first direction, i.e. radially across the secondary fuel and air mixing duct 70, transversely relative to the streamwise direction, across a major portion of the secondary fuel and air mixing duct 70. Each hollow member 98 has the same dimension in the first direction at one portion 107 along its length, and radially with respect to the tubular combustion chamber 28. Each hollow member 98 has a gradual reduction in dimension in a second direction, perpendicular to the first direction and transversely relative to the streamwise direction, between a first end 100 secured to the secondary fuel manifold 94 and a second end 102 in the secondary fuel and air mixing duct 70. The hollow member 98 reduces in dimension in the first direction between the first end 100 and the portion 107. Thus each hollow member 98 reduces in cross-sectional area from its first end 100 to its second end 102.

Each hollow member 98 has a passage 104 which extends longitudinally from the first end 100 of the hollow member 98 at the secondary fuel manifold 94 towards but to a position spaced from the second end 102 of the hollow member 98. The second end 102 of each hollow member 98 has a plurality of discharge apertures 106. The apertures 106 are spaced apart about the end of the hollow member 98 generally in a plane extending in a second direction designated by the arrow B which is perpendicular to the first direction designated by the arrow A, in the first direction and are arranged to direct fuel perpendicularly to the first direction, i.e. in the second direction. There are apertures 106 provided to discharge fuel from both sides of the hollow member 98 in the second direction, but in opposite directions. The passage 104 interconnects with the discharge apertures 106 to supply fuel from the secondary fuel manifold 94 to the discharge apertures 106. It can be seen that the discharge apertures 106 on each hollow member 98 are thus spaced apart radially with respect to the secondary fuel and air mixing duct 70 and that they discharge fuel generally in circumferential directions. Thus each fuel injector 96 discharges fuel towards the adjacent fuel injectors 96.

The hollow members 98 of the fuel injectors 96 extend across a major portion of the secondary fuel and air mixing ducts 70 such that they effectively aerodynamically divide the duct 70 into a number of separate mixing ducts. The fuel injectors 96 thus divide the secondary fuel and air mixing duct 70 into separate mixing ducts as well as serving to supply fuel into the separate mixing ducts. There is negligible mass flow between the radially inner and outer ends of the hollow member 98 and the annular walls 72 and 74 defining the secondary fuel and air mixing duct 70. The fuel injectors 96 extend only part of the length of the secondary fuel and air mixing duct 70.

Figure 6:
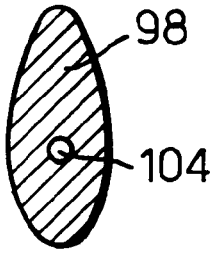
FIG. 6 is a cross-sectional view in the direction of arrows 6—6 in FIG. 5.
Figure 7:
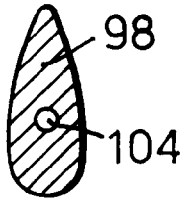
FIG. 7 is a cross-sectional view in the direction of arrows 7–7 in FIG. 5.
Figure 8:
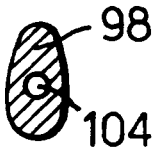
FIG. 8 is a cross-sectional view in the direction of arrows 8—8 in FIG. 5.
Figure 9:
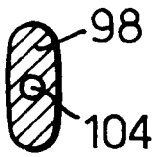
FIG. 9 is a cross-sectional view in the direction of arrows 9—9 in FIG. 5.
Figure 10:
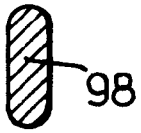
FIG. 10 is a cross-sectional view in the direction of arrows 10—10 in FIG. 5.

The hollow members 98 are aerofoil shaped in cross-section over the region 105, as shown in FIGS. 6 and 7, but the hollow members 98 blend, as shown in FIG. 8, to a race track shape cross-section in region 107, as shown in FIGS. 9 and 10. The hollow members 98 are aerofoil shaped at region 105 to allow a smooth aerodynamic flow of air transversely of the hollow members 98, within the casing 124, without disturbance to the first and second radial flow swirlers 60 and 62. The hollow members 98 are race track shaped at region 107 to provide a smooth aerodynamic flow of air lengthwise of the hollow members 98 into the secondary fuel and air mixing duct 70. The second end 102 of the hollow members 98 is a very thin edge so that substantially no, or very little, turbulence is generated by the air flow passing through the secondary fuel and air mixing duct 70 along the hollow members 98 as it leaves the second end 102.

A plurality of tertiary fuel systems 108 are provided, to supply fuel to the tertiary fuel and air mixing ducts 82 of each of the tubular combustion chambers 28. The tertiary fuel system 108 for each tubular combustion chamber 28 comprises an annular tertiary fuel manifold 110 arranged coaxially with the tubular combustion chamber 28. The tertiary fuel manifold 110 is positioned outside the casing 124, but may be positioned in the casing 124. Each tertiary fuel manifold 110 has a plurality, for example thirty two, of equi-circumferentially spaced tertiary fuel injectors 112. Each of the tertiary fuel injectors 112 comprises a hollow member 114 which extends initially radially inwardly and then axially with respect to the tubular combustion chamber 28 from the tertiary fuel manifold 110 in a downstream direction through the intake 88 of the tertiary fuel and air mixing duct 82 and into the tertiary fuel and air mixing duct 82. Each hollow member 114 extends in a downstream direction along the tertiary fuel and air mixing duct 82 to a position, sufficiently far from the intake 88, where there are no recirculating flows in the tertiary fuel and air mixing duct 82 due to the flow of air into the duct 82.

Each hollow member 114 extends in a first direction, i.e. radially across the tertiary fuel and air mixing duct 82, transversely relative to the streamwise direction, across a major portion of the tertiary fuel and air mixing duct 82. Each hollow member 114 has the same dimension in the first direction at all positions along its length which are within the tertiary fuel and air mixing duct 82. Each hollow member 114 has a gradual reduction in dimension in a second direction, perpendicular to the first direction and transversely relative to the streamwise direction, between a first end 116 and secured to the tertiary fuel manifold 110 and a second end 118 in the tertiary fuel and air mixing duct 82. Thus each hollow member 114 reduces in cross-sectional area from its first end 116 to its second end 118.

Each hollow member 114 has a passage 120 which extends longitudinally from the first end 116 of the hollow member 114 at the tertiary fuel manifold 110 towards but to a position spaced from the second end 118 of the hollow member 114. The second end 118 of each hollow member 114 has a plurality of discharge apertures 122. The apertures 122 are spaced apart in the first direction and are arranged to direct fuel perpendicularly to the first direction, ie in the second direction. There are apertures 122 provided to discharge fuel from both sides of the hollow member 114 in the second direction, but in opposite directions. The passage 120 interconnects with the discharge apertures 122 to supply fuel from the tertiary fuel manifold 110 to the discharge apertured 122. It can be seen that the discharge apertures 122 on each hollow member 120 are thus spaced apart radially with respect to the tertiary fuel and air mixing duct 82 and that they discharge fuel generally in circumferential directions.

Similarly the hollow members 114 of the fuel injectors 112 extend across a major portion of the tertiary fuel and air mixing ducts 82 such that they effectively aerodynamically divide the duct 82 into a number of separate mixing ducts. The fuel injectors 112 thus divide the tertiary fuel and air mixing duct 82 into separate mixing ducts as well as serving to supply fuel into the separate mixing ducts. There is negligible mass flow between the radially inner and outer ends of the hollow member 114 and the annular walls 84 and 86 defining the tertiary fuel and air mixing duct 82. The fuel injectors 112 extend only part of the length of the tertiary fuel and air mixing duct 82.

Figure 2:
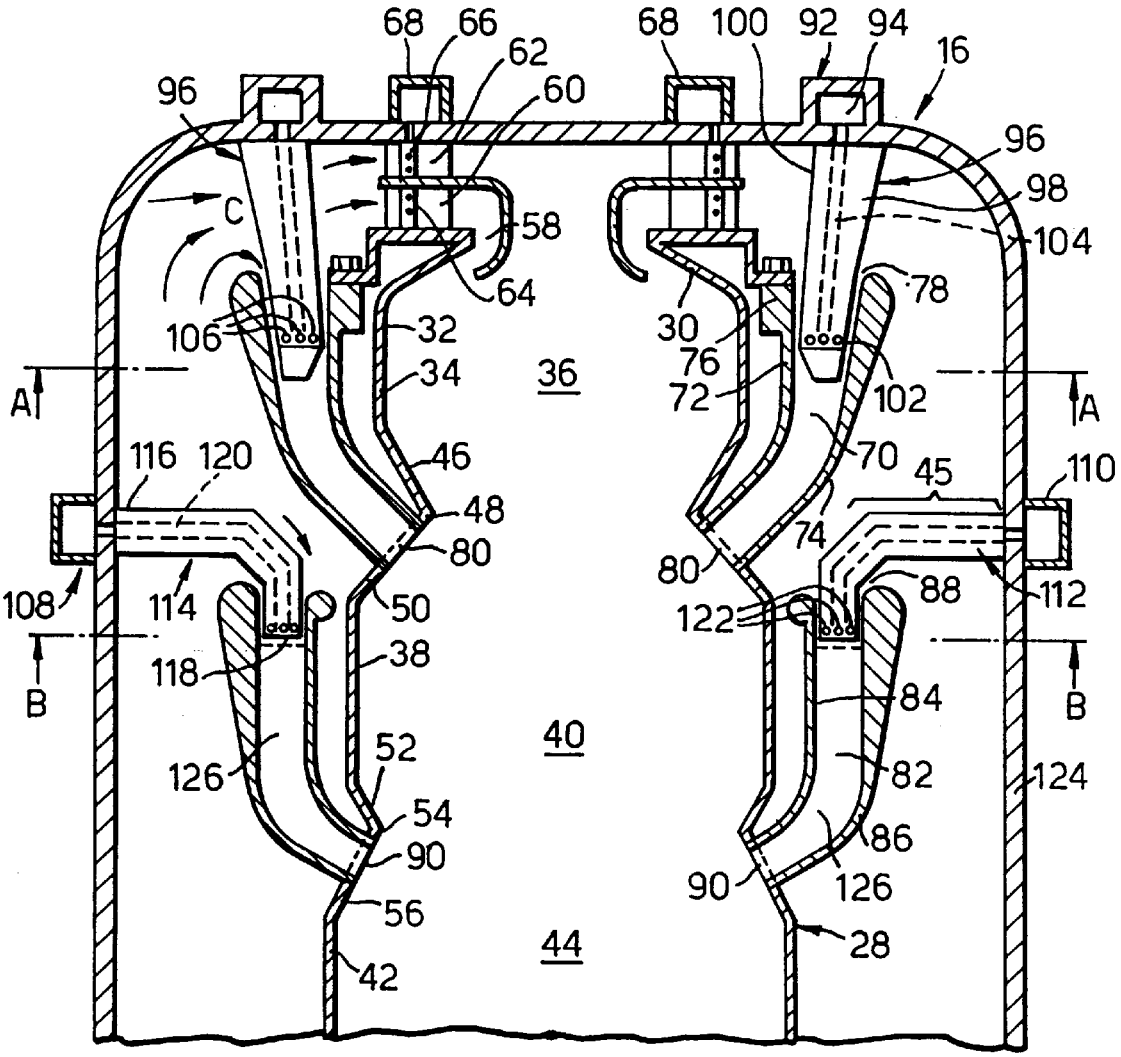
FIG. 2 is an enlarged longitudinal cross-sectional view through the combustion chamber shown in FIG. 1.
Figure 4:
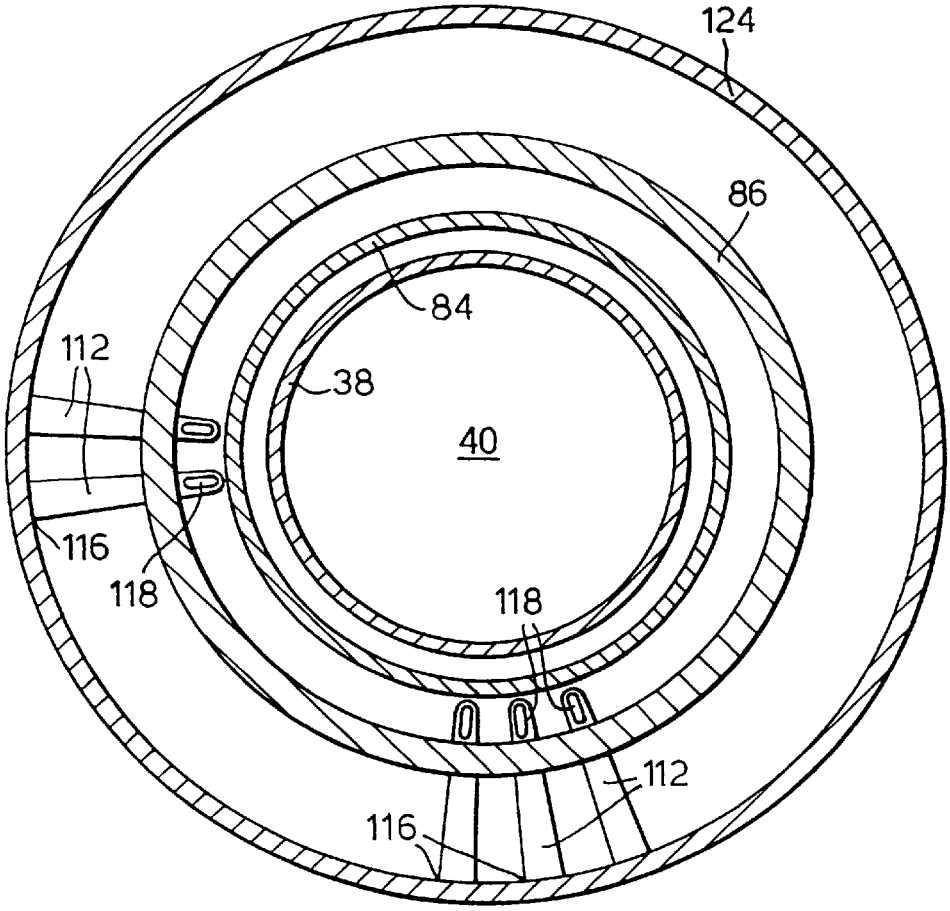
FIG. 4 is a cross-sectional view in the direction of arrows 4—4 in FIG. 2.
Figure 5:
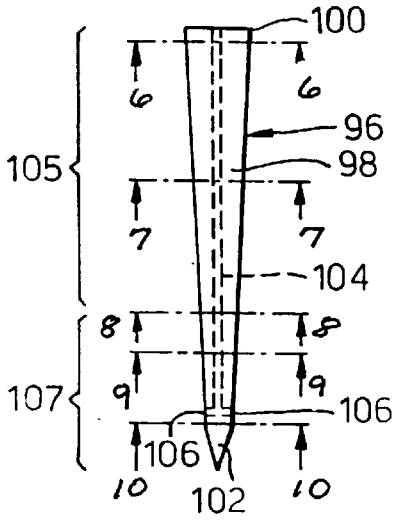
FIG. 5 is an enlarged partial view in the direction of arrow C in FIG. 2 showing a single fuel injector.

The hollow members 114 are aerofoil shaped in cross-section over the region 115, as shown in FIG. 2, but the hollow members 114 are race track shape in cross-section in region 117 as shown in FIG. 2. The hollow members 114 are aerofoil shaped at region 115 to allow a smooth aerodynamic flow of air transversely of the hollow members 114, within the casing 124, without disturbance to the first and second radial flow swirlers 60 and 62 and to the secondary fuel and air mixing duct 70. The hollow members 114 are race track shaped at region 117 to provide a smooth aerodynamic flow of air lengthwise of the hollow members 117 into the tertiary fuel and air mixing duct 82. The second end 118 of the hollow members 114 is a very thin edge so that substantially no, or very little, turbulence is generated by the air flow passing through the tertiary fuel and air mixing duct 82 along the hollow members 114 as it leaves the second end 118.

The secondary and tertiary fuel manifolds 94 and 110 are positioned outside the combustion casing 124 which encloses the tubular combustion chamber 28.

In operation there is an accelerating flow of air through the secondary and tertiary fuel and air mixing ducts 70 and 82 respectively due to the aerodynamically smooth shape of the ducts and due to the fact that the secondary and tertiary fuel and air mixing ducts 70, 82 reduce in cross-sectional area between their intakes 78, 88 at their upstream ends and the apertures 80, 90 at their downstream ends. The accelerating flow of air through the mixing ducts 70 and 82 reduces or prevents the formation of recirculating zones in the mixing ducts 70 and 82, and this in turn reduces or eliminates the possibility of burning of the fuel injected into the mixing ducts 70 and 82.

The fuel injectors 96 and 112 extend from respective fuel manifolds 94 and 110 positioned outside the combustion chamber casing 124. The locating of fuel manifolds outside the combustion chamber casing 124 has the advantage that there is no possibility of fuel leaking from the fuel manifolds into the mixing ducts 70 and 82 and hence the possibility of fires in the mixing duct 70 and 82 is reduced. It is not necessary to have seals internally of the combustion chamber casing for this design, nor is it necessary to have supply pipes with expansion/contraction capability.

The distances from the discharge apertures 106, 122 to the respective apertures 80, 90 is maintained as large as is possible for optimum mixing of the fuel and air while ensuring that the discharge apertures 106, 122 are sufficiently far away from the intakes 78, 88 of the mixing ducts 70, 82 such that any fuel injected from the injectors 96, 112 does not migrate into any recirculating zones at the intakes 78, 88 of the mixing ducts 70, 82.

It is possible that fuel injectors at all positions around the annular mixing ducts have the same degree of tapering. However, it may be possible to vary the degree of tapering of the fuel injectors at various positions around the annular mixing ducts.

The invention has described fuel injectors which extend only part of the length of the mixing duct. However, if the mixing duct is substantially straight, the fuel injectors may extend the full length of the mixing duct to fully divide the mixing duct into separate mixing ducts. In this case the fuel injectors may have constant cross-sectional area throughout the length of the mixing duct.

It may be possible to subdivide the mixing duct at its downstream end with radially extending walls. For example the tertiary fuel and air mixing duct 82 has radial walls 126 indicated by the broken lines in FIG. 2. The downstream ends 118 of the fuel injectors 112 are positioned immediately adjacent to, or close to, the upstream ends of the walls 126 such that the fuel injectors 112 and walls 126 cooperate to completely divide the tertiary fuel and air mixing duct 82 from the intake 88 to the apertures 90. The fuel injectors may have constant cross-sectional area throughout the length of the tertiary mixing duct. The walls may be secured to both annular walls 84 and 86 or secured to only one of the walls 84,86.

I claim:

1. A gas turbine engine fuel injector comprising a member having a first end and a second end, the member reducing in cross-sectional area in the longitudinal direction from the first end to the second end, the member reducing in dimension in a first direction perpendicular to the longitudinal direction from the first end to the second end, the member having a passage extending longitudinally therethrough for the supply of fuel from the first end towards the second end, the member having a plurality of discharge apertures at a predetermined distance from the second end, the discharge apertures being spaced apart in a second direction which is substantially perpendicular to both the first direction and the longitudinal direction, the apertures being arranged to direct fuel substantially in the first direction, at least a portion of the member having a substantially constant dimension in the second direction, a portion of the fuel injector reducing in dimension in the second direction between the first end of the member and the portion of the member having a constant dimension in the second direction.

2. A gas turbine engine fuel injector comprising a member having a first end and a second end, the member reducing in cross-sectional area in the longitudinal direction from the first end to the second end, the member reducing in dimension in a first direction perpendicular to the longitudinal direction from the first end to the second end, the member having a passage extending longitudinally therethrough for the supply of fuel from the first end towards the second end, the member having a plurality of discharge apertures at a predetermined distance from the second end, the discharge apertures being spaced apart in a second direction which is substantially perpendicular to both the first direction and the longitudinal direction, the apertures being arranged to direct fuel substantially in the first direction, at least a portion of the member having a substantially constant dimension in the second direction, the portion of the member which has a substantially constant dimension in the first direction has a race track cross-section.

3. A gas turbine engine fuel injector comprising a member having a first end and a second end, the member reducing in cross-sectional area in the longitudinal direction from the first end to the second end, the member reducing in dimension in a first direction perpendicular to the longitudinal direction from the first end to the second end, the member having a passage extending longitudinally therethrough for the supply of fuel from the first end towards the second end, the member having a plurality of discharge apertures at a predetermined distance from the second end, the discharge apertures being spaced apart in a second direction which is substantially perpendicular to both the first direction and the longitudinal direction, the apertures being arranged to direct fuel substantially in the first direction, at least a portion of the member having a substantially constant dimension in the second direction, the at least a portion of the member being adjacent the second end of the member, a portion of the fuel injector reducing in dimension in the second direction between the first end of the member and the portion of the member having a constant dimension in the second direction, the portion of the member reducing in dimension in the second direction has an aero-foil cross-section.

4. A gas turbine engine fuel injector comprising a member having a first end and a second end, the member reducing in cross-sectional area in the longitudinal direction from the first end to the second end, the member reducing in dimension in a first direction perpendicular to the longitudinal direction from the first end to the second end, the member having a passage extending longitudinally therethrough for the supply of fuel from the first end towards the second end, the member having a plurality of discharge apertures at a predetermined distance from the second end, the discharge apertures being spaced apart in a second direction which is substantially perpendicular to both the first direction and the longitudinal direction, the apertures being arranged to direct fuel substantially in the first direction, the second end of the member having a sharp edge.

5. A gas turbine engine fuel injector comprising a member having a first end and a second end, the member reducing in cross-sectional area in the longitudinal direction from the first end to the second end, the member reducing in dimension in a first direction perpendicular to the longitudinal direction from the first end to the second end, the member having a passage extending longitudinally therethrough for the supply of fuel from the first end towards the second end, the member having a plurality of discharge apertures at a predetermined distance from the second end, the discharge apertures being spaced apart in a second direction which is substantially perpendicular to both the first direction and the longitudinal direction, the apertures being arranged to direct fuel substantially in the first direction, a first portion of the member having an aero-foil cross-section and a second portion having a race track cross-section.

6. A fuel injection as claimed in claim 5 in which the first portion is at the first end of the member and the second portion is at the second end of the member.

* * * * *